United States Patent [19]

Vossen

[11] 4,449,744

[45] May 22, 1984

[54] CARRYING OR HOLDING DEVICE FOR AT LEAST ONE CUP OR THE LIKE VESSEL AS WELL AS A BLANK THEREFORE

[75] Inventor: Franz Vossen, Stockach, Fed. Rep. of Germany

[73] Assignee: Meurer Non Food Product GmbH, Radolfzell, Fed. Rep. of Germany

[21] Appl. No.: 288,025

[22] Filed: Jul. 29, 1981

[30] Foreign Application Priority Data

Jul. 31, 1980 [DE] Fed. Rep. of Germany ..... 3029047

[51] Int. Cl.[3] ..... B65D 71/00; B65D 85/62

[52] U.S. Cl. ..... 294/87.2; 294/158

[58] Field of Search ..... 294/87.2, 87.22, 87.26, 294/87.28; 206/427, 197, 148, 153, 158, 199, 426

[56] References Cited

U.S. PATENT DOCUMENTS

| | | | |
|---|---|---|---|
| 3,363,928 | 1/1968 | Hange et al. | 294/87.2 |
| 3,414,313 | 12/1968 | Schwarz | 294/87.2 |
| 3,653,503 | 4/1972 | Arneson | 294/87.2 |

*Primary Examiner*—James B. Marbert

*Attorney, Agent, or Firm*—Roberts, Spiecens & Cohen

[57] ABSTRACT

A carrying and holding device comprising a plate or the like having provision for receiving a cup or the like, especially a fruit or yogurt cup and including laterally bent up edge portions to secure the cup for storage in groups within boxes. The carrying device is formed from a flat sheet of cardboard or the like which is folded to form a rectangular case with a recess for the cup, the spacing between two facing edges of the recess being less than the diameter of the cup so as to be deformed to hold the rim of the cup while gripping its side wall.

8 Claims, 4 Drawing Figures

CARRYING OR HOLDING DEVICE FOR AT LEAST ONE CUP OR THE LIKE VESSEL AS WELL AS A BLANK THEREFORE

BACKGROUND OF THE INVENTION

The invention relates to a carrying and holding device with a plate or the like and at least one provision for receiving a cup or like vessel, especially a fruit or yogurt cup with laterally bent up edge pieces or the like.

There are known trays with several circular recesses placed side by side, where ice and yogurt cups are inserted and held by means of their peripheral frames; this frame lies round the edge frame of the recess, the diameter of the latter corresponds to the external diameter of the cup, that is under the circle frame.

It is usual to store ice and yogurt cups in boxes which are divided into sections in order to fix the cups. Interiors which are divided into sections can be also equipped in the way described with relation to trays.

SUMMARY OF THE INVENTION

It is an object of the invention to provide a carrying and holding device especially for fruit, ice and yogurt cups where these can be fixed easily and stored in groups within the boxes. Additionally, the carrying or holding device should be capable of inexpensive and easy manufacture.

This object is achieved by the invention in that the carrying device is equipped like a case with sides forming the plate for the recess(es), whereas the distance between two opposite parts of the edges of the recesses is less than the external width of the area of the cup touching them and these edges are temporarily deformable. Preferably, there are recesses with two edges—at least in a certain area—placed opposite to each other and in that distance, whereas each of them is formed by means of a strip of material with at least one radial edge cut towards the cup.

The scope of the invention also covers a blank for the carrying device in the form of a strip comprising cardboard or like material which is divided into two narrow edge strips by means of parallel broken lines and the areas between these strips are provided with two neighboring central strips. One surface at least shows one of the recesses with at least one diameter—see above—which is less than the maximum external diameter of the cup and framed by flexible frame pieces.

Preferably, the device substantially comprises cardboard and is simply manufactured from a strip which, as mentioned above, is provided with broken lines.

With regard to the desire for simple manufacture a case is provided with a perpendicular transverse cut—that is to say main planes parallel to each other on one hand and on the other hand side walls—, however, other forms of transverse cuts are also possible. It has been found to be advantageous to use perpendicular, especially square recesses without making the invention dependent on these preferred forms.

The radial edge cuts—of cylindrical cups—divide the lateral material or frame strip in several sections; the latter enabling that, when pressing the cup on to the plane with these recesses, the cup can be easily inserted into these recesses because of the strip pieces which move to the side and that these frame parts because of the elastic force of the material return into their original position stopping towards the edge of the cup to serve as holding tongues.

It has been found advantageous that the case comprises a plate or plane placed opposite to the first plate as well as narrow side walls as a connection between the two planes. The side walls are a little higher than the width of the material or frame strip next to the side walls. The frame strip are divided by the said edge cuts and connected by means of the transverse strip. There are bent lines between the latter and the material strip.

The plate placed on the opposite side of and spaced from to the recesses is—according to the invention—provided for a support for the edges of the cups. The transverse strip extend to the interior planes of the plate by means of the edge of the cup and—for use—they are placed between the edge of the cup and the support plate.

When the cup is introduced into the case and their frame strip and side walls are, by this means, bent towards each other, each side wall of the case with the neighboring material strip and a part of the support plate placed over the latter form a seam-like hollow edge profile which—in preferred example—has a triangular—statically especially advantageous—transverse cross-section.

According to the invention, the introduction of the cup deforms the edge profile and/or its frame strip at least in the area of the edge cuts, since there the side of the cup touches the frame strip and pushes it towards the outside.

In order to enable an easy assembly of the new case, so that it can be used, the bent lines are pressed between the frame strip on one hand and the transverse stripes on the the other hand into the cardboard or blank strip in the opposite direction to the said broken lines; the latter are all impressed in a commun direction.

A factor of particular significance with regard to the invention is the uncomplicated design thereof, as will become evident from the following description taken with reference to the drawing.

BRIEF DESCRIPTION OF THE FIGURES OF THE DRAWING

Further advantages, features, and details of the invention will become evident from the following description of preferred embodiments given with reference to the drawings, in which.

DETAILED DESCRIPTION

Figure 1:
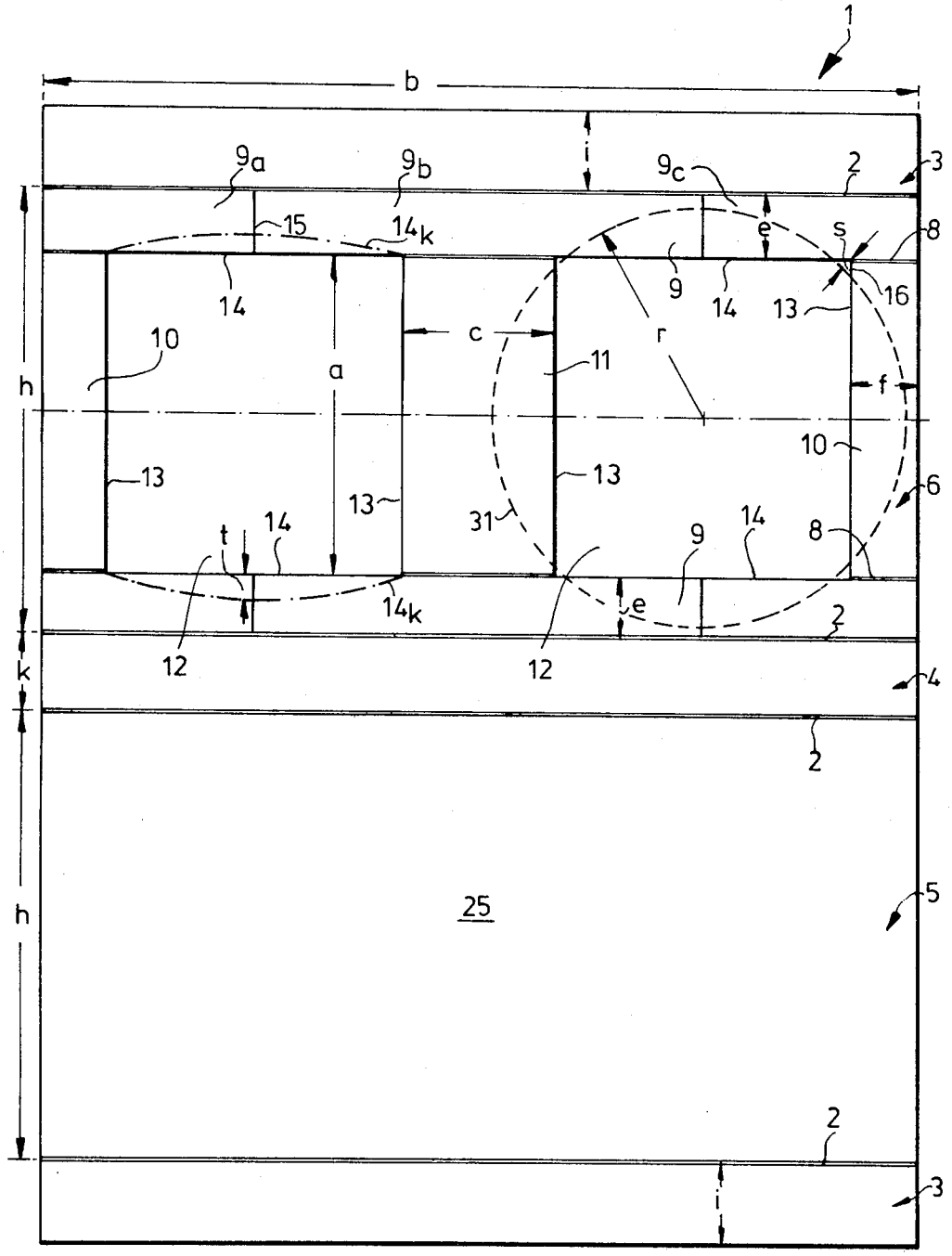
FIG. 1 is a schematic plan view of a cardboard cut for a cup holder.

A cardboard strip 1 with a width b of for examle, 160 mm is divided by means of broken lines 2 into two narrow edge strip 3 with a height i of about 12 mm and two plate regions or areas 5,6 each joining the latter and being connected by a narrow middle strip 4.

The height h of the areas 5,6 is about 80 mm, whereas the height k of middle strip 4 is only slightly greater than the height i of the edge strip 3.

The area 5 is plain, whereas in the area 6 two frame edges 9 are formed by two bend lines 2 parallely bordering the area 6, as well as bend lines 8 extending at in a distance e of about 10 mm from lines 2.

These frame edges 9 are connected with each other by two transverse frame pieces 10 of approximately the same width f and a middle frame piece 11 with a width c, so that two cut-outs 12 resulting from cut lines 13, 14 with a square design and a height a of approximately 55 mm remain between the frame pieces 9, 10, 11. These cut lines 14 partially extend along the bend line 8. (FIG. 1)

Figure 2:
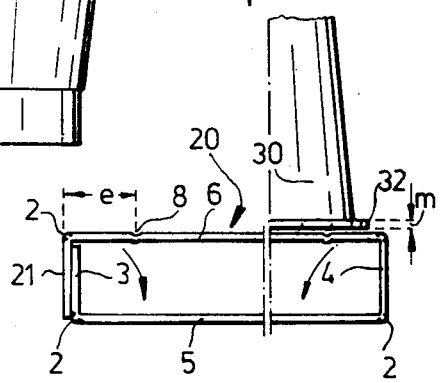
FIG. 2 is a front view of the cup holder.
Figure 3:
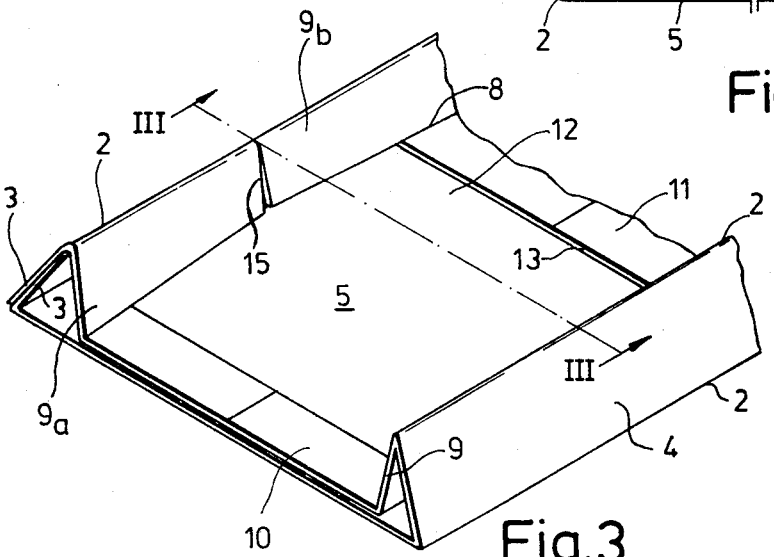
FIG. 3 is a perspective view of the cup holder in an other position than in FIG. 2.

Both edge strips 3 are put superimposed and fixed by adhesive, so that the cardboard strip 1 accordiing to FIG. 2 becomes a cardboard case 20 with a rectangular design.

Figure 4:
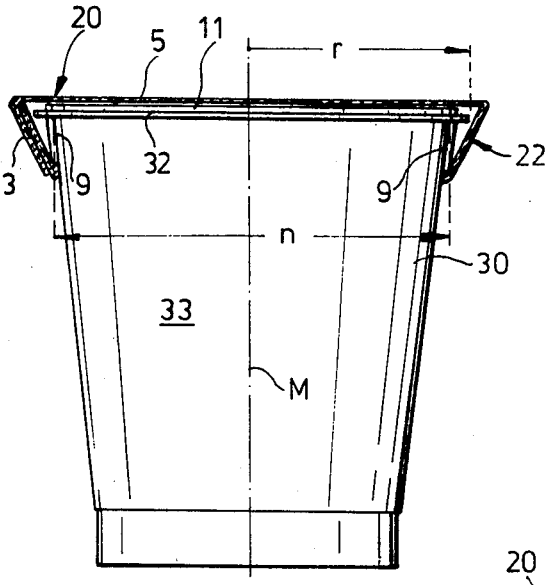
FIG. 4 is a cross section through FIG. 3 corresponding approximately to line III—III with the addition of a cup.

If a fruit cup 30 with a cantilever ring edge 32 with a radius r (for example 35 mm) is put on the area 6 and pressed in the direction X against the cardboard case 20, the frame edges 9 are bent to the bottom and the sides of the case 21 to their inside. Each of the frame edges 9 is divided by edge cuts 15 extending transversely of the recesses 12. The pushing edge of the cup 32—the outline 31 of which is shown in FIG. 1 before assembling the cardboard case 20—opens parts *9a, 9b, 9c* of the frame edges 9. The edge 32 of the cup passes through the frame edges according to FIG. 2, 3 which then snap together. The walls 33 of the cups 30 hold the frame edges 9 bent, so that they form solid beaded edges 22 (FIG. 4) with a triangular cross section.

With the case sides 21 and part of plane 5 the deformed cardboard case 20 carries the cup(s) 30 without further means; the middle axe M of the fruit cup 30 is fixed vertically to plane 5; the latter preventing the cover foil of the fruit cup 30—which is not shown in the drawing for the sake of clarity—from damage and, additionally its plane surface 25 serves as a means of advertisement.

The cut lines 14, according to FIG. 1 may be curved by a vertical distance t of, for example, 2 mm from the straight line 14 towards the neighboring fold line 2, so that cutting edges resulting from the cut lines $14_k$ do not touch the facing plane 5 even with a considerable deflection of the frame edge 9 by the edge 32 of the fruit cup (or beer can or like vessel 30). In other respects the distance s of the triangular cut-out 16 resulting from the cutting edges 13 and 14 approximately $14_k$ at the corners of the cut-out as short sides and from the circular line 31 as the approximate long side, depends on the height m of the edge of the cup—and, the stronger the latter, the greater the distance s, so that a perfect gripping behind the frame pieces *9a, 9b,* and/or *9b, 9c* is guaranteed.

The unit comprising the cardboard case 20 and the fruit cup 31 held by the case—with an external diameter n of the wall 33—can be put into the market and sold in the described way. However, it may also be possible to store a plurality of these units in a box—not shown in the drawing—that is used in commerce, even when the interior of the box is divided in sections.

What is claimed is:

1. A carrying or holding device for a cup having a cantilever ring edge, said device comprising a flat sheet of material having a pair of spaced fold lines centrally located in said sheet to form a middle strip and two plate regions of equal size extending on opposite sides of said strip, each of said plate regions including a respective edge strip foldably connected to the remainder of the associated plate region remote from said middle strip, said edge strips having a width in relation to said middle strip such that with said plate regions folded about said fold lines into juxtaposed position and said strips overlapped and secured a rectangular shaped case is formed, one of said plate regions being plain, the other being provided with a cut out and adjoining frame edges respectively foldably connected to said middle strip and the edge strip associated with said other plate region, said frame edges each being provided with a straight transverse cut extending to said cut-out and being foldable inwardly towards said plain plate region upon insertion of a cup with a cantilever ring edge thereon to form respective triangular shaped edge portions for said case which rip the inserted cup and which form free edges on said edge portions which hold the cantilever ring edge of the cup.

2. A device as claimed in claim 1 wherein said other plate region is provided with parallel, transverse and longitudinal cut lines extending partially along the transverse and longitudinal extent of said other plate region to form said cut-out.

3. A device as claimed in claim 2 wherein said cut-out is of square shape.

4. A device as claimed in claim 1 wherein said triangular shaped edge portions are formed with side walls of substantially equal size.

5. A device as claimed in claim 2 wherein said other plate region includes transverse strips bordering said cut-out and extending to said frame edges whereat said transverse strips are respectively foladably connected to said frame edges.

6. A device as claimed in claim 5 wherein two of said cut-outs are provided by respective transverse and longitudinal cut lines, a further transverse strip being formed between said two cut-outs and extending to said frame edges whereat said further transverse strip is foldably connected to said frame edges.

7. A device as claimed in claim 1 wherein said sheet of material is cardboard.

8. A device as claimed in claim 1 wherein said cut-out has a diagonal extent which is greater than the ring edge of the cup such that corners of the cut-out form triangles with the periphery of the ring edge.

* * * * *